United States Patent [19]

Mascola

[11] 3,998,465

[45] Dec. 21, 1976

[54] TELEPHONE RANDOM NUMBER GAME

[76] Inventor: Donald C. Mascola, 230 Harvard Road, Linden, N.J. 07036

[22] Filed: Mar. 24, 1972

[21] Appl. No.: 237,866

[52] U.S. Cl. ..... 273/139; 273/135 B; 283/6

[51] Int. Cl.[2] ..... A63F 3/06

[58] Field of Search ..... 273/139, 135 B, 135 BC; 283/6, 48, 49, 50, 56

[56] References Cited

UNITED STATES PATENTS

| | | | |
|---|---|---|---|
| 2,203,183 | 6/1940 | Schuman et al. | 273/139 |
| 2,409,584 | 10/1946 | Peterman | 273/135 B |
| 2,610,855 | 9/1952 | Spiller | 273/139 X |
| 3,281,165 | 10/1966 | Edge | 273/139 UX |
| 3,556,530 | 1/1971 | Barr et al. | 273/139 |
| 3,594,004 | 7/1971 | Barr et al. | 273/139 |

FOREIGN PATENTS OR APPLICATIONS

| | | | |
|---|---|---|---|
| 872,703 | 7/1961 | United Kingdom | 273/135 B |

OTHER PUBLICATIONS

"Eraso", copyrighted 1971 by Spot-O-Gold Corp., Phila., Pa., U.S. Pat. No. 3,281,165.

*Primary Examiner*—Richard C. Pinkham
*Assistant Examiner*—Arnold W. Kramer
*Attorney, Agent, or Firm*—Friedman, Goodman & Teitelbaum

[57] ABSTRACT

A method of gathering random numerical intelligence in a number game, the method including registering part of numerical random intelligence in isolated zones upon a master card, concealing the isolated zones independently from one another with peelable opaque strips, providing to participants a plurality of game-carrier cards upon each of which is already indicated certain of the numerical intelligence, exposing the isolated zones of concealed numerical intelligence at selected time intervals respectively, and recording the exposed numerical intelligence on a recording-playback machine associated with a telephone answering unit, the participants determining from the telephone answering unit which of the exposed numerical intelligence corresponds to that intelligence on the carrier cards.

5 Claims, 3 Drawing Figures

FIG. 1.
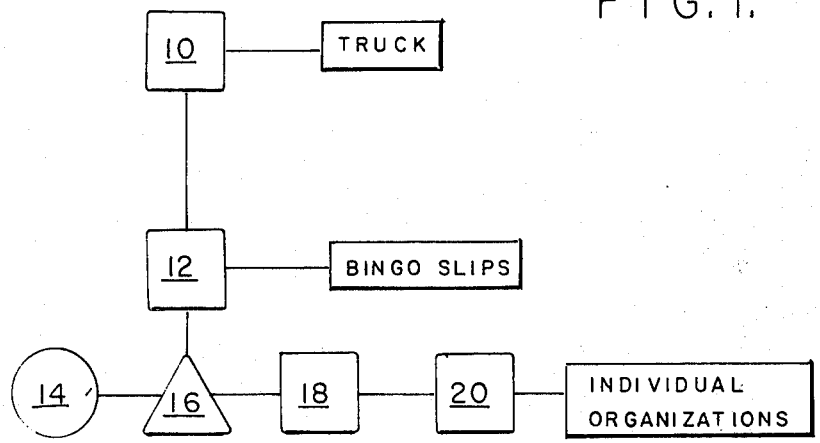
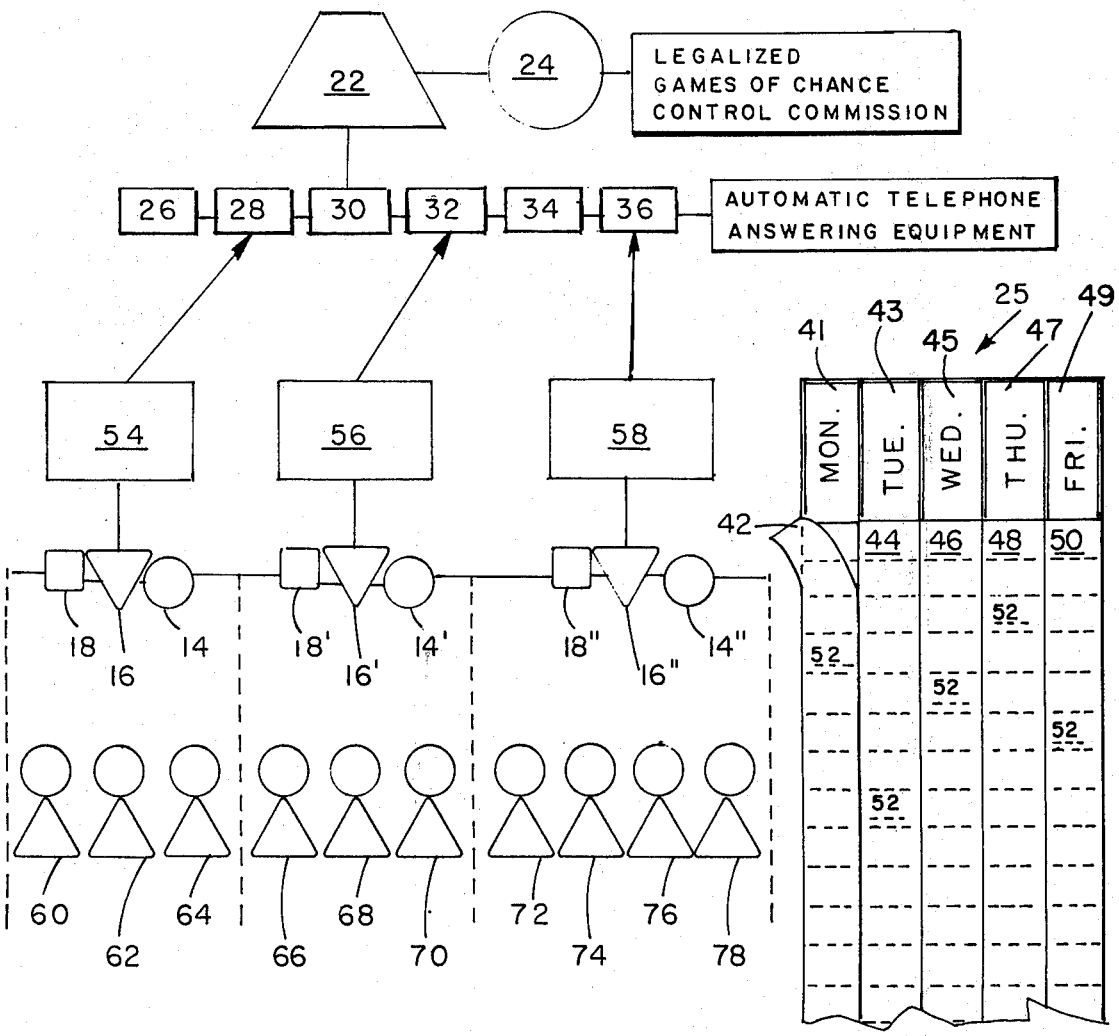
FIG. 2.

TELEPHONE RANDOM NUMBER GAME

BACKGROUND OF THE INVENTION

The present invention relates generally to a method of gathering random intelligence in a number game, and more particularly to the conventional game called "BINGO".

The game BINGO generally involves a rather restrictive requirement that all game participants commonly assemble at a selected location to permit the game to proceed until such time as one or a plurality of participants are declared "winner or winners". Each of the participants is provided with one or a plurality of game cards differing from one another at least partially in that each game card is provided with a row of letters B, I, N, G and O, and five columns of numerical subject-matter associated with the aforementioned letters respectively, the difference relating to the specific numerical subject-matter as appearing on the cards and the location of the numerical subject-matter relative to the row of letters.

The game is generally controlled by a person who may be characterized as a "caller" who selects, at random, successive game pieces from a master drum, upon which pieces is indicated a combination of alphabetical and numerical subject-matter, the alphabetical subject-matter comprising one of the letters B, I, N, G or O, whereas the numerical subject-matter includes one or two digits generally. The caller than announces the alphabetical-numerical intelligence as displayed on these pieces so that the various game participants may indicate upon their respective cards which of the alphabetical-numerical intelligence appearing on their cards corresponds to the announced intelligence by the caller. The game ends when one or a plurality of the participants, pursuant to prescribed rules, has either filled his entire card with appropriate intelligence markers such as discs or the like, or has filled his card in a particular orientation such that the card displays markers having a vertical line, horizontal line, diagonal line, or other configuration.

Usually, the first participant to publically and loudly declare BINGO will, in fact, be declared the game "winner". Clearly, this involves not merely a loudly declared public announcement of the word "BINGO", but inherently requires both a recognition on the part of each of the participants that the game card is, in fact, filled in a particular orientation or entirely and an immediate response with a public declaration of the statement BINGO in order to win the game. Often, a number of participants commonly have winning cards filled either entirely or in a prescribed orientation, yet depending upon their reflexes or the extent of concentration devoted to the game, each will loudly and publically declare the statement BINGO, some earlier than others. This obviously requires a recognition on the part of the caller as to who is, in fact, the winner and clearly presents problems for both the participants and the caller alike in those instances wherein the game rules do not permit a plurality of winners to be declared within a particular or prescribed time-limit after a calling of a particular piece as selected from the master drum.

Another serious problem as associated with the conventional manner of playing the game BINGO is the fact that since the game is played within the confines of a particular location or game hall, notwithstanding the size of the hall, the number of participants is limited to a prescribed maximum amount and the game must be played within a prescribed maximum time. Therefore, the various religious, charitable or other organizations which run the game of BINGO for the public at large, cannot do so in the most practical and efficient manner in terms of comfort and convenience as associated with the various participants, and in terms of the extent of profit that the particular organization can realize from running each of the particular games.

SUMMARY OF THE INVENTION

Accordingly, the present invention relates generally to a number game such as the game BINGO wherein the number of participants is not at all limited to the confines of a particular location, wherein the time for playing each game need not be limited to the size of or availability of any particular location, and wherein maximum control is permitted for running the game effectively, reliably and efficiently.

It is another object of the present invention to provide a method of playing a number game in which various numbers are selected and, thereafter, recorded on a recording-playback machine or a mass calling system associated with devices in the nature of a telephone answering unit available to the game participants for defining the randomly selected subject-matter.

To this end, the present invention may be characterized generally as a method of gathering random intelligence in a number game, said method comprising providing a source of generally random numerical intelligence, selecting and registering part of said random numerical intelligence in isolated groups, concealing said isolated groups independently from one another, providing a plurality of carriers upon each of which is already indicated differently certain of the random numerical intelligence from said source, exposing said isolated groups of concealed random numerical intelligence successively at selected time intervals respectively, determining from the exposed isolated groups which of the numerical intelligence on the carriers coincides therewith, and indicating on said carriers the coinciding numerical intelligence.

BRIEF DESCRIPTION OF THE DRAWINGS

With the above and additional objects and advantages in view as will hereinafter appear, this invention comprises the devices, combinations and arrangements of parts hereinafter described and illustrated in the accompanying drawings of a preferred embodiment in which:

FIG. 1 illustrates schematically the steps taken for playing the number game pursuant to one mode or method thereof;

FIG. 2 illustrates a master card to be utilized pursuant to the mode illustrated generally in FIG. 1.

DETAILED DESCRIPTION OF THE INVENTION

Figure 3:
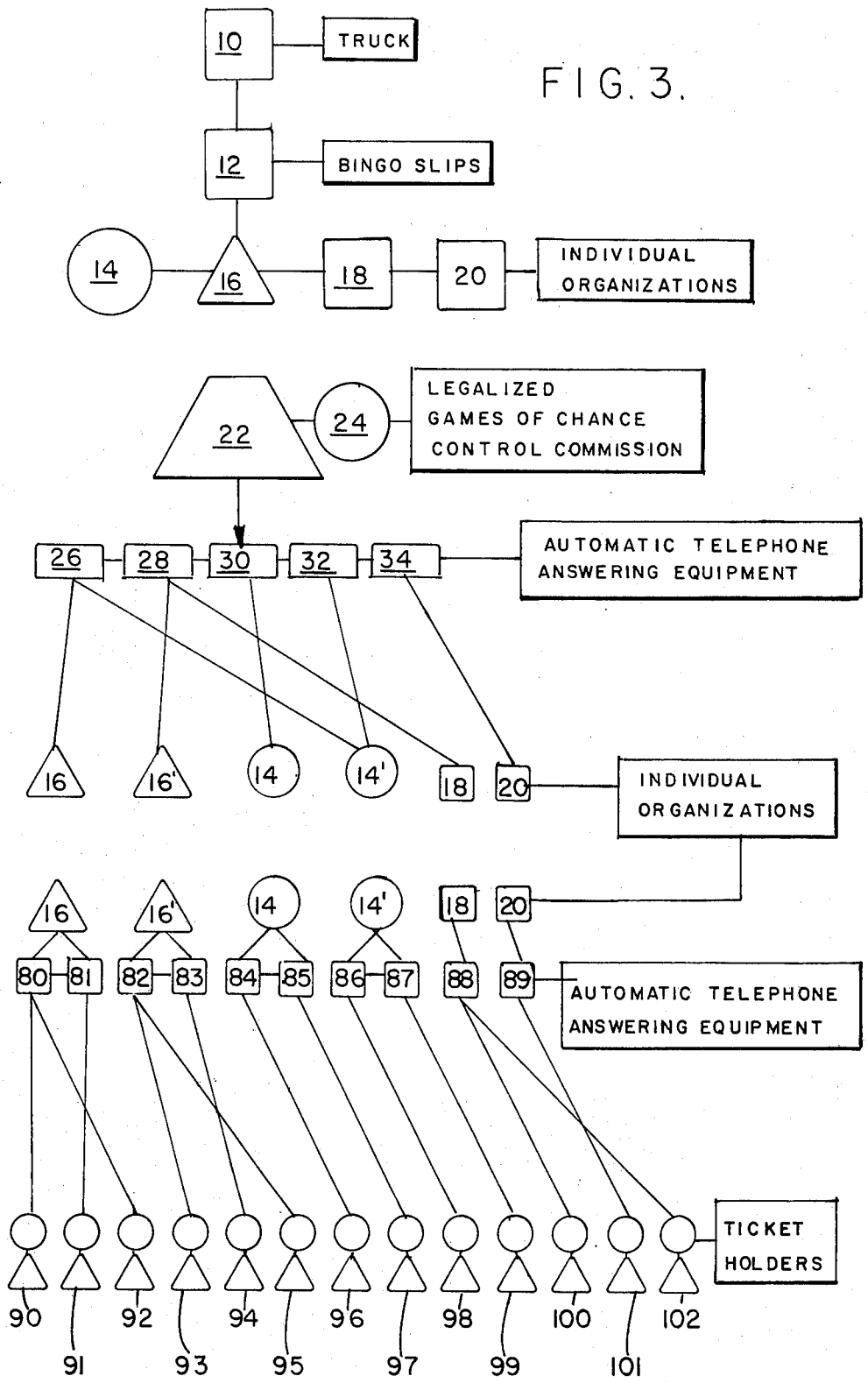
FIG. 3 illustrates a schematic representation of an alternate mode or method of playing the game pursuant to the present invention.

Referring now to the drawings and more particularly to FIGS. 1 and 2 thereof, the present invention can be generalized as a method of gathering random intelligence in a number game, such as the game BINGO.

In this respect, the game may be controlled by a municipal or other governmental agency and requires the distribution, such as by means of the trucks or the like and denoted by reference character 10, of conventional Bingo cards or slips denoted by the reference character 12, the Bingo slips or cards 12 characterized herein as carriers upon which are provided the letters B, I, N, G and O, as a row along the top thereof, and five columns of numerical subject-matter constituted of one or two digits in association with each of the aforementioned letters. The carriers or Bingo cards 12 differ from one another with regard to the specific numerical subject-matter thereon and the specific location of the numerical subject-matter as associated with the row of letters. The Bingo cards 12 are produced in great quantity and, thereafter, delivered such as by means of the trucks 10 to various individual organizations of religious, charitable or other nature and denoted by the reference characters 14, 16, 18 and 20 etc.

As indicated above, the game is to be controlled by a municipal or other governmental agency and may be characterized as a "legalized games of chance control commission" and denoted by the reference character 22. The commission 22 pursuant to the principal of the present invention will select a prescribed quantity of alphabetical-numerical intelligence from a source 24 of generally random intelligence, each selection relating to a specific letter from the group of letters "B, I, N, G and O" and a number constituted of either one or two digits. Each of these combinations of both alphabetical and numerical subject-matter is then registered upon a master card denoted by the reference character 25 in FIG. 2. Each of the master cards 25 is to be utilized for one game until the completion thereof pursuant to prescribed rules as will be clarified below.

In this respect, the control commission 22 is provided with automatic telephone answering equipment in association with recording-playback units denoted by the reference characters 26, 28, 30, 32, 34 and 36 respectively. Each master game card 25 is to be divided into isolated zones or groups of alphabetical-numerical intelligence combinations, the zones, columns in this instance, denoted generally by the reference characters 41, 43, 45, 47 and 49 respectively, each of the zones relating to specific time intervals such as the days of the week, Monday through Friday respectively.

Overlying each of the groups or zones of alphabetical-numerical combinations of intelligence, for purposes of concealing the intelligence of each of the zones independently from one another, are a plurality of opaque peelable strips 42, 44, 46, 48 and 50 respectively, the intelligence denoted by the reference character 52 and underscored in broken line, the intelligence 52 differing from one another notwithstanding the common use in FIG. 2 of reference character 52. Each of the opaque peelable strips 42, 44, 46, 48 and 50 respectively is generally heat-sealed or the like to the respective zones or columns over which the strips are superposed, so that upon removal or peeling of a selected strip, such as strip 42, the latter illustrated in a partially peeled condition, for purposes of exposing the numerical intelligence thereunder, the strips cannot, thereafter, be resealed without being undetected. In other words, once a particular strip is peeled or partially peeled from the zone associated therewith, because of the manner by which the strip is sealed to the zone, the strip cannot be restored to its unpeeled condition and any attempt to reseal the strip may be easily detected, this preventing exposure of the intelligence thereunder earlier than permitted by the game rules.

Pursuant to the rules of the game, the control commission 22 will peel, for example on Monday, strip 42 for exposing the numerical intelligence thereunder and immediately record these combinations of alphabetical-numerical subject-matter onto the recording-playback apparatus 26, 28, 30, 32, 34 and 36 respectively as associated with the automatic telephone answering equipment therefor. These units 26–36 may be characterized as a primary or a master answering service to be associated with secondary master complexes 54, 56 and 58 respectively which are likewise controlled by the control commission 22.

These secondary complexes 54, 56 and 58 respectively for purposes of geographical convenience are likewise provided with recording-playback apparatus as associated with telephone answering equipment and will feed or permit the individual organizations 14, 14′, 14″, 16, 16′, 16″, 18, 18′, 18″, to relay and inform either manually or automatically, visually or audiably, those game participants who purchased the Bingo cards or slips 12 therefrom, the participants denoted by the reference characters 60, 62, 64, 66, 68, 70, 72, 74, 76, 78 etc. respectively, the nature of the exposed intelligence. The game participants aforementioned can either call the individual organizations for determining whether or not the game cards or carriers 12 in their possession, as purchased from these organizations, are provided with the specific alphabetical-numerical combinations as relayed to the organizations through the control commission 22 such as by means of the primary and secondary master complexes associated with automatic telephone answering equipment, or may call the secondary complexes 54, 56 and 58 directly in order to obviate the telephone burden of the organizations themselves.

This procedure is repeated for each day successively, the zone of intelligence for that particular day being exposed by peeling the strip superposed thereon in heat sealed fashion or the like, the exposed intelligence recorded upon the primary and secondary telephone answering units so as to permit the game participants to record the game card alphabetical-numerical intelligence coinciding with the intelligence as exposed for that day. The peeling or exposure of each of the zones relative to one another is successively followed until a participant declares himself to be a winner, in that the participant has completely, or otherwise, filled his card in a particular orientation by denoting the coinciding intelligence thereon. Each of the participants need not at all be restricted to a particular location and may in fact travel throughout the country and simply by means of a telephone call learn whether or not the subject-matter as appearing on his purchased cards 12 coincides with the intelligence on the master card 25 as exposed by the control commission 22.

The above description is suggestive of one particular mode or method of playing the game pursuant to the present invention and is very much similar to an alternate method as illustrated in FIG. 3. In this instance, likewise, Bingo slips or cards 12 are delivered such as by means of vehicles or trucks 10 to appropriate individual organizations 14, 16 18, and 20, of religious, charitable or other nature, the latter which distribute or sell these tickets or cards to individual game participants.

Likewise, a legalized games of chance control commission or other municipal agency 22 selects appropriate intelligence from a source 24 and records the intelligence on a master card similar to that of the card denoted by the reference character 25 in FIG. 2. The game proceeds in the same manner as the various zones of intelligence, which are isolated from one another independently, are exposed and recorded on appropriate telephone answering equipment 26, 28, 30, 32 and 34. The individual organizations 16, 16′, 14, 14′, 18 and 20 thereafter call the control commission 22 and are automatically provided with the exposed intelligence through the answering equipment 26–34. Thereafter, the individual organizations themselves record the exposed intelligence or their own telephone answering equipment 80–89 so that participants 90–102 can in turn call the individual organizations and be provided with or informed of the nature of the intelligence as exposed by the control commission 22.

The primary distinction between the method of playing the game is illustrated in FIG. 1 as compared to that method illustrated in FIG. 3, is that in the first instance, namely FIG. 1, a number of secondary master complexes are provided for relaying the intelligence as exposed by the control commission 22 so as to ease the telephonic burden of a single control commission, whereas in the second instance, FIG. 3, the individual organizations are themselves specifically provided with telephone answering equipment and derive information directly from the control commission 22 via the telephone answering equipment of the latter.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A method of gathering random intelligence in a number game, said method comprising the steps of:

providing a source of numerical intelligence including a plurality of elements each having an alphabetical-numerical combination of at least one letter and at least one digit providing different numbers, randomly selecting a first predetermined quantity of said elements of said source and registering said letters and numbers of said first predetermined quantity in a first isolated group, randomly selecting at least a second predetermined quantity of said elements of said source and registering said letters and numbers of said second predetermined quantity in a second isolated group, concealing said first and second isolated groups independently from one another, providing a plurality of carrier members, said carrier members being separate and apart from said first and second isolated groups, representing a portion of said source on each of said carrier members in similar row and column arrangements with the numerical intelligence on one carrier member differing from the numerical intelligence on another carrier member, said row being formed of said letters and said column being formed of said numbers associated with said letters respectively, distributing said carrier members to various participants with said first and second isolated groups being maintained at one location, exposing all of said first quantity of letters and numbers in said first group at a predetermined time, allowing sufficient time for the participants to determine from the exposed first group which of said numerical intelligence represented on said carrier members coincides therewith to obtain a winner of said number game having a particular orientation denoted by the coinciding numerical intelligence represented on one of said carrier members, exposing all of said quantity of letters and numbers in said second group after said sufficient time during which no winner has been obtained by said exposed first group, and allowing a second sufficient time for the participants to determine from the exposed first and second groups which of said numerical intelligence represented on said carrier members coincide therewith to obtain said winner of said number game having said particular orientation denoted by the coinciding numerical intelligence represented on one of said carrier members which was determined by said exposed first and second groups.

2. A method as claimed in claim 1 wherein said registering of said first and second predetermined quantities comprises imprinting said first and second predetermined quantities on at least one master card in predetermined zones which constitute said first and second isolated groups respectively.

3. A method as claimed in claim 2 wherein said concealing of said isolated groups independently from one another comprises applying peelable opaque strips to said master card over each of said zones respectively such that said strips are sealed and free from being undetectably resealed when peeled from the associated zones.

4. A method as claimed in claim 3 including heat-sealing said peelable opaque strips to said zones.

5. A method as claimed in claim 1 including, after exposing each of said isolated groups successively, communicating said exposed quantity of letters and numbers respectively to the participants.

* * * * *